US005540423A

United States Patent [19]

Nakano

[11] Patent Number: 5,540,423

[45] Date of Patent: Jul. 30, 1996

[54] SHEET FEEDING DEVICE HAVING A PLURALITY OF ROLLERS POSITIONED SIDE BY SIDE

[75] Inventor: Hiroshi Nakano, Nagoya, Japan

[73] Assignee: Brother Kogyo Kabushiki Kaisha, Nagoya, Japan

[21] Appl. No.: 408,042

[22] Filed: Mar. 21, 1995

[30] Foreign Application Priority Data

Mar. 30, 1994 [JP] Japan ..... 6-61385

[51] Int. Cl.[6] ..... B65H 5/00

[52] U.S. Cl. ..... 271/10.12; 271/10.11; 271/114; 271/119; 271/242; 271/274; 271/270

[58] Field of Search ..... 271/10.05, 10.09, 271/10.11, 10.12, 114, 119, 242, 248, 274, 270

[56] References Cited

U.S. PATENT DOCUMENTS 5,022,642 6/1991 Hasegawa et al. ..... 271/10.12

FOREIGN PATENT DOCUMENTS 0346220 12/1989 European Pat. Off. ..... 271/242

Y2-64-1304 1/1989 Japan .

403133845 6/1991 Japan ..... 271/242

*Primary Examiner*—H. Grant Skaggs

*Attorney, Agent, or Firm*—Oliff & Berridge

[57] ABSTRACT

A sheet feeding device avoiding diagonal feeding of a sheet for use in an image forming apparatus. The image forming apparatus includes a sheet cassette and a sheet supply roller unit positioned deviatedly with respect to a widthwise center of the cassette. The deviated position of the sheet supply roller provides rotational force to the sheet for causing diagonal feeding thereof. The sheet feeding device includes a plurality of feed rollers arrayed side by side in the widthwise direction of the sheet. One feed roller positioned close to the sheet supply roller unit provides the sheet feeding force greater than that of the remaining sheet feed roller positioned far away from the sheet supply roller for providing a linear relationship between a resultant sheet feeding force and a resultant resistive force in a direction parallel with the sheet feeding direction. The difference in sheet feeding force is provided by changing nipping pressure of the feed rollers, friction coefficient thereof, or peripheral speed thereof.

20 Claims, 6 Drawing Sheets

SHEET FEEDING DEVICE HAVING A PLURALITY OF ROLLERS POSITIONED SIDE BY SIDE

BACKGROUND OF THE INVENTION

The present invention relates to a sheet feeding device, and more particularly, to a type thereof having a plurality of rollers positioned side by side in a widthwise direction of a sheet to be transferred.

In a conventional laser printer, a word processor or a copying machine, a sheet feeding device is provided for transferring a sheet stacked in a sheet cassette or tray to an image recording portion such as a photosensitive drum and a print head. The conventional sheet feeding device has rollers whose rotation axes are aligned with each other in the widthwise direction of the sheet.

In such a conventional sheet feeding device, various forces are imparted on the sheet in addition to the sheet feeding force by the plurality of rollers. For example, additional roller is provided at upstream or downstream side of the plurality of rollers, which additional roller may provide sheet feed force or resistive force against sheet feeding. Further, the sheet to be transferred may be imparted with frictional force by the surface contact with succeeding sheet stacked on the sheet tray.

Particularly, for supplying the sheet on the sheet tray to the plurality of rollers, a sheet supply roller unit is provided upstream of the plurality of rollers. The sheet supply roller unit may be positioned offset from the widthwise center of the sheet to be transferred in order to make the sheet supply roller unit available for various kind of sheets of different width. With this arrangement, after the sheet reaches the plurality of rollers by the sheet supply roller unit yet the sheet is still in contact with the sheet supply roller, the sheet supply roller unit may provide a deviated resistive force against the sheet feeding force by the plurality of rollers.

Accordingly, resultant resistive force is not aligned with resultant sheet feeding force in the sheet feeding direction, so that the sheet may be imparted with rotational force. As a result, the sheet is oriented diagonally with respect to the sheet feeding direction, and consequently, a diagonal image may be provided on the sheet at the image recording portion.

SUMMARY OF THE INVENTION

It is therefore, an object of the present invention to overcome the above-described drawbacks and to provide an improved sheet feeding device capable of avoiding diagonal orientation of the sheet during its feeding.

This and other objects of the present invention will be attained by providing an improved sheet feeding device for feeding a sheet to a desired position in an image forming apparatus. The image forming apparatus has a sheet cassette for accommodating therein a stack of sheets and a sheet supply roller unit for supplying an uppermost sheet of the sheet stack to a position out of the sheet cassette. The sheet feeding device has a plurality of feed rollers arrayed side by side in a widthwise direction of the sheet and positioned downstream of the sheet supply roller unit with respect to a sheet feeding direction. The sheet supply roller unit is positioned deviatedly with respect to an array of the plurality of feed rollers, and partly provides resistive force against sheet feeding. At least one of the plurality of feed rollers provides sheet feeding force different from the remaining plurality of feed rollers for providing a linear alignment between a resultant sheet feeding force provided by the plurality of feed rollers and a resultant resistive force against sheet feeding in a direction parallel with the sheet feeding direction.

BRIEF DESCRIPTION OF THE DRAWINGS

In the drawings;

FIG. 6(*b*) is a view for description of a resultant sheet feeding force and resultant resistive force with respect to a minimum size sheet P1;

FIG. 7(*b*) is a cross-sectional view taken along the line VII—VII of FIG. 7(*a*)

Figure 1:
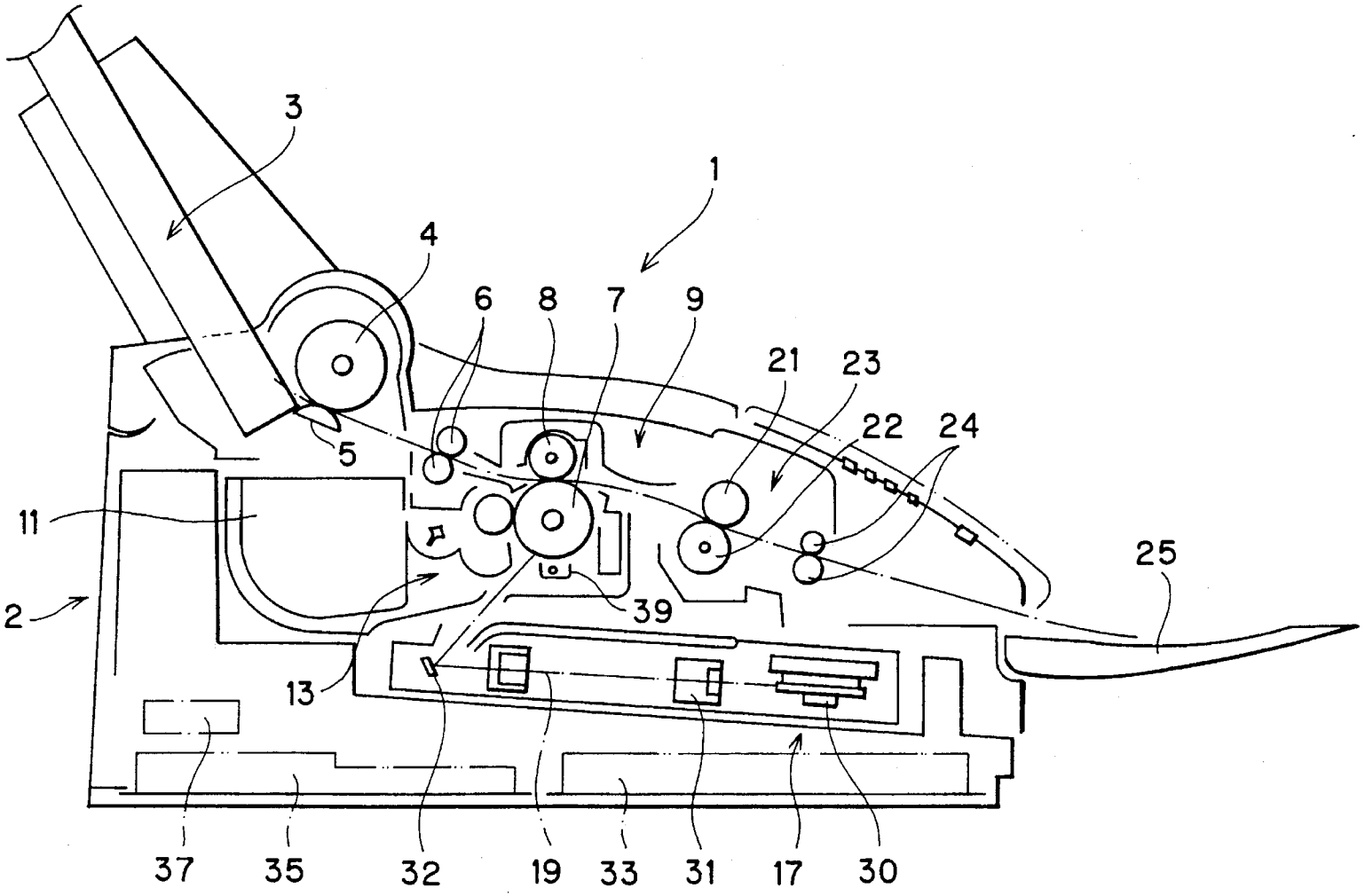
FIG. 1 is a schematic illustration showing an internal arrangement of a laser printer having a sheet feeding device according to a first embodiment of the present invention.

A second embodiment is not referred in this section. However, the second embodiment will be described with reference to the drawings attendant to the first embodiment.

DETAILED DESCRIPTION OF THE PREFERRED EMBODIMENTS

A sheet feeding device according to a first embodiment of the present invention will be described with reference to FIGS. 1 through 6(*b*). The sheet feeding device is employed in a laser beam printer 1 shown in FIG. 1. The laser printer 1 has a frame body 2 whose rear upper portion is detachably provided with a sheet cassette 3. At a cassette installing portion, a sheet supply roller unit 4 and a holder 5 in pressure contact with the sheet supply roller unit 4 are provided for separating an uppermost sheet P from the sheet stack in the cassette 3 and supplying the uppermost sheet to an image recording portion such as a developing unit 9 through feed rollers 6.

The developing unit 9 includes a photosensitive drum 7, an image transfer roller 8 in nipping relation to the photosensitive drum 7, a charger 39, a toner cartridge 11 for accumulating therein toners, and a developing portion 13 to which toners are supplied from the toner cartridge 11. A scanner unit 17 is provided for emitting laser beam 19 so as to provide an image on the sheet P. Further, control boards 33 and 35 and a power unit 37 are provided on a bottom wall of the frame body 2.

The scanner unit 17 is disposed below the developing unit 9 and includes a laser beam generating portion 30, a lens 31 and a reflection mirror 32. An external equipment such as a computer (not shown) transmits image data to the control board, so that the scanner unit 17 emits laser beam 19 in accordance with the image data. Thus, an electrostatic latent image is formed on the surface of the photosensitive drum 7 provisionally charged by the charger 39 in accordance with the image data. The developing portion 13 visualizes the latent image by the magnetized toners, and then the toner image is transferred onto the sheet P nipped between the photosensitive drum 7 and the image transfer roller 8.

An image fixing unit 23 including a heat roller 21 and a pressure roller 22 is provided downstream of the developing unit 9 for thermally fixing a toner image on the sheet P. A pair of discharge rollers 24 are provided downstream of the fixing unit 23 for discharging the image carried sheet onto a discharge tray 25.

Figure 2:
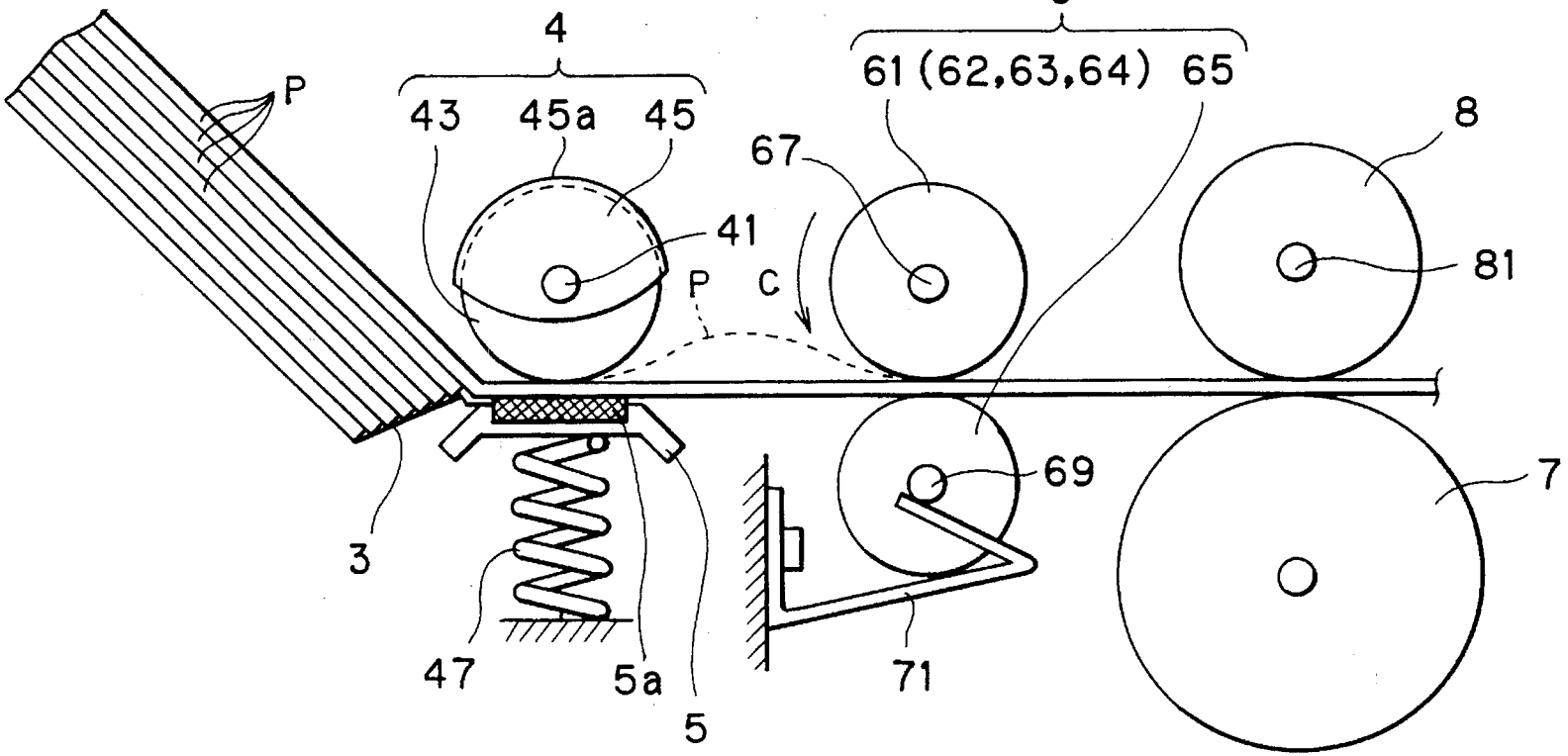
FIG. 2 is a schematic side view showing the sheet feed arrangement from a sheet supply roller unit to an image transfer roller according to the first embodiment.
Figure 3:
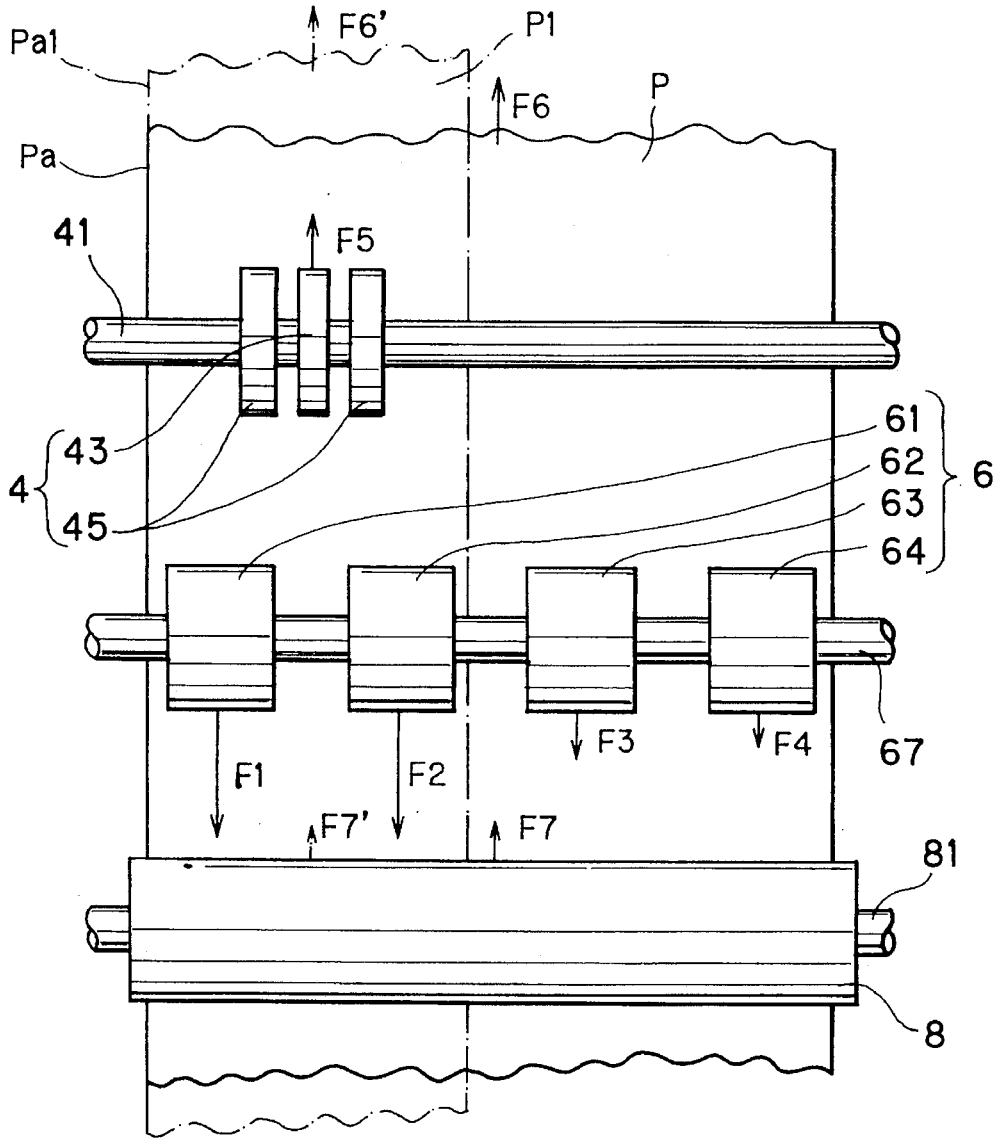
FIG. 3 is a schematic plan view showing the sheet feed arrangement from the sheet supply roller unit to the image transfer roller according to the first embodiment.

The supply roller unit 4 and the sheet feed rollers 8 are shown in FIGS. 2 and 3. The supply roller unit 4 includes a rotation shaft 41, a free rotation roller 43 and a pair of integral rotation rollers 45. The free rotation roller 43 is formed of a synthetic resin and is rotatably supported on the rotation shaft 43. The free rotation roller 43 has a circular cross-section. The integral rotation rollers 45 are provided integrally with the rotation shaft 41 and positioned to sandwich the free rotation roller 43 between the integrally rotation rollers 45. The integral rotation rollers 45 have generally semicircular shape and have diameter greater than that of the free rotation roller 43. The semicircular surfaces **45*a* of the integral rotation rollers 45 are provided with rubber linings. The outer peripheral surface of the free rotation roller 43** has a friction coefficient lower than that of the rubber lining.

The holder 5 includes a separation pad **5*a* at a position in contact with the integral rotation rollers 45. Further, a coil spring 47 is held on a lower surface of the holder 5 so that the separation pad 5*a* is urged toward the sheet supply roller unit 4**.

The laser printer of this kind must form images on various sheets having width different from each other. To this effect, the sheet cassette 3 has a width capable of accommodating sheets P having a maximum width. As shown in FIG. 3, the sheet supply roller unit 4 is positioned offset from the widthwise center of the sheet cassette 3, that is, the position of the sheet supply roller unit 4 is deviated toward one edge of the sheet P, the edge being in parallel with the feeding direction of the sheet. A sheet P1 having a minimum width can be installed on the sheet cassette 3 in such a manner that the position of an edge Pa1 of the minimum size sheet P1 is aligned with the position of an edge Pa of the maximum size sheet P. The sheet supply roller unit 4 is positioned at a widthwise center of the minimum size sheet P1.

Since one side edge of the sheet is always positioned at an identical position Pa1 (Pa) regardless of the size of the sheets, print start position at the developing unit 9 can be maintained constant regardless of the size of the sheets. Accordingly, a sheet size sensor and a sheet size setting key are not required, to thereby provide compact and light weight laser printer 1 at low cost.

As shown in FIGS. 2 and 3, the sheet feed rollers 6 includes resist rollers 61, 62, 63, 64 and corresponding pinch rollers 65 in confronting relation to the respective resist rollers for nipping the sheet P between the resist roller and the pinch roller. A plurality of resist rollers (four rollers) are arrayed in the widthwise direction of the sheet and are provided side by side in coaxial fashion relative to a rotation shaft 67. These resists rollers 61–64 have identical diameters and are provided integrally with the rotation shaft 67. These rollers 61–64 are formed of rubber.

Figure 4:
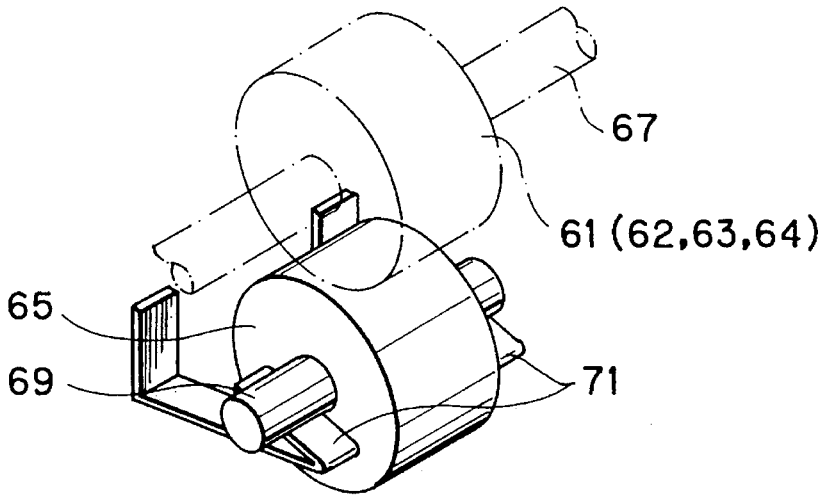
FIG. 4 is a schematic perspective view showing a pinch roller according to the first embodiment.

On the other hand, as best shown in FIG. 4, each pinch roller 65 is provided freely rotatable about its rotation shaft 69 extending therethrough. Each rotation shaft 69 is supported by a set of resilient members such as leaf springs 71, so that the each pinch roller 65 is urged toward the corresponding resist roller 61. Here, displacement amount of one set of the leaf springs, which one set supports one pinch roller, is different from that of another set of the leaf springs which another set supports another pinch roller. As a result, nipping force between one resist roller and one pinch roller becomes different from that between the other resist roller and other pinch roller. In the illustrated embodiment, the nipping force with respect to the resist rollers 61, 62, 63 and 64 are **700*g*, 700*g*, 350*g*, and 50*g***, respectively.

The image transfer roller 8 positioned downstream of the sheet feed rollers 6 has an axial length to support the maximum width sheet P. The image transfer roller 8 is rotatable about a rotation shaft 81 in nipping relation to the photosensitive drum 7 through the sheet P.

In the laser printer 1, thus constructed, the sheets P stacked on the sheet cassette 3 will be fed to the image transfer roller 8 in the following manner: Each one of the sheet P is nipped between the semicircular surfaces **45*a* of the integral rollers 45 and the separation pad 5*a*. A leading edge of the sheet P reaches a portion between the resist rollers 61–64 and pinch rollers 65 after the integral rollers 45 are angularly rotated by an angle which defines the semi-circular surface, i.e., from one semi-circular edge to the other semicircular edge. In this case, each resist rollers 61–64 is stopped or is rotated in a direction opposite to the sheet feeding direction. The sheet feed length given by the semicircular portion 45*a* of the integral rollers 45 is slightly greater than a distance between the integral rollers 45 and the resist rollers 61–64. Therefore, when the leading edge of the sheet P abuts the nipping portion between the resist rollers 61–64 and the pinch rollers 65, the sheet will be deflected or slacken as shown by a broken line in FIG. 2. As a result, the leading edge line will be directed in parallel with the axial direction of the rotation shaft 67**.

Then, the rotation of the integral rotation rollers 45 is stopped while the sheet P is faced against and spaced away from the chordal faces of the integral rotation rollers 45. Thereafter, each resist roller 61–64 starts rotation in a direction for feeding the sheet P toward the image transfer rollers 8. Thus, the sheet P is fed to the image transfer roller 8. The peripheral speed of the image transfer roller 8 is lower than that of the resist rollers 61–64. Therefore, a toner image can surely be transferred onto the sheet P. In this case, the free rotation roller 43 of the sheet supply roller unit 4 and the separation pad **5*a* nip therebetween the trailing edge portion of the sheet P, and the free rotation roller 43** is rotated in accordance with the sheet feeding.

With this sheet feeding manner, the sheet P is subjected to the following force: As shown in FIG. 3, the resist rollers 61, 62, 63, 64 those being rotated integrally with the rotation of the rotation shaft 67 imparts sheet feeding forces F1, F2, F3 and F4 to the sheet P. However, pressing forces provided by the resist rollers 63 and 64 against the sheets are lower than that provided by the resist rollers 61 and 62, and therefore, the sheet feeding forces F3 and F4 are smaller than that of F1 and F2. (As a matter of convenience, ratio of the length of the force vector F1, F2, etc. shown in FIGS. 3 and 6 is different from the ratio of magnitude of forces.)

As described above, since the integral rotation rollers 45 of the sheet supply roller unit 4 are stopped with a space from the sheet P, these rollers 45 do not impart load onto the sheet P. On the other hand, since the free rotation roller 43 of the sheet supply roller unit 4 and the separation pad 5*a* still nip therebetween the sheet P, and therefore, resistive force F5 is exerted onto the sheet P against the sheet feeding forces. Further, the trailing edge portion of the sheet P is still on the sheet cassette 3, and therefore, resistive force F6 is exerted onto the sheet P against the sheet feeding force due to the frictional relation relative to the succeeding sheet in the sheet cassette 3. Furthermore, since the peripheral speed of the transfer roller 8 is lower than that of the resist rollers 61, 62, 63, 64, another resistive force F7 is imparted onto the sheet P.

Figure 6A:
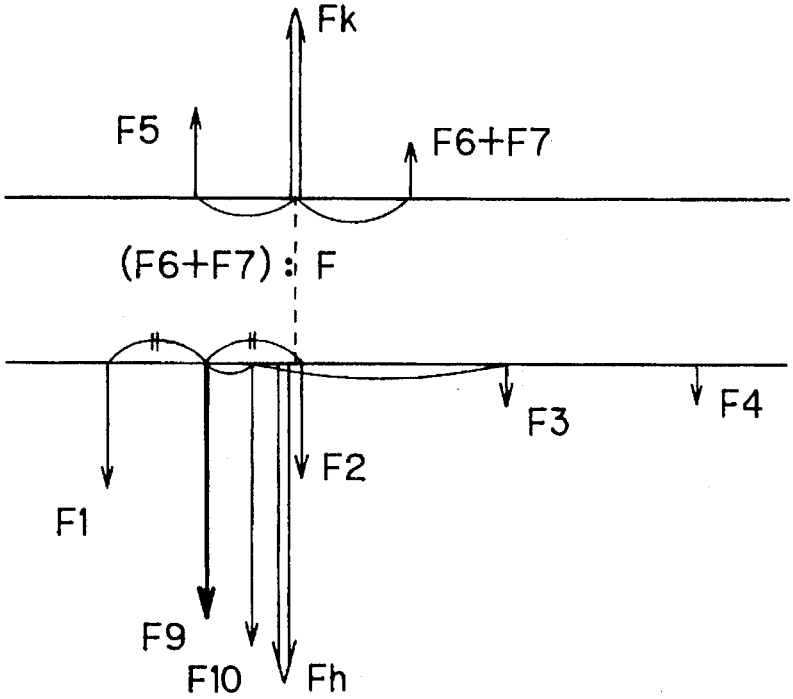
FIG. 6(*a*) is a view for description of a resultant sheet feeding force and resultant resistive force with respect to a sheet P.
Figure 6B:
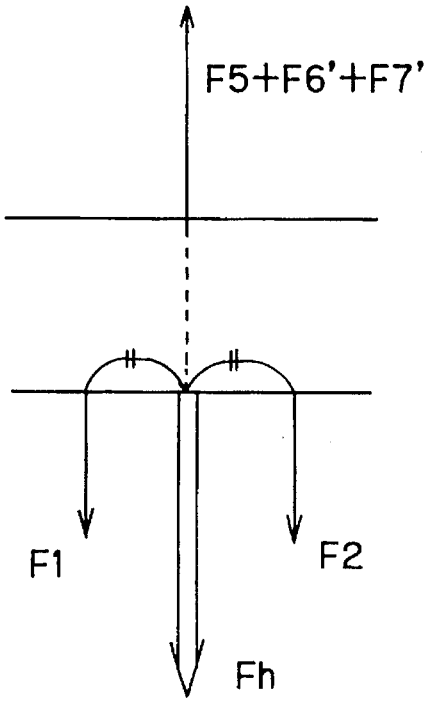

Each point of action of the sheet feeding forces F1, F2, F3, F4 and the resistive force 5 is located at each widthwise center of the roller at a position in contact with the sheet P. The widthwise center implies a point dividing each axial length of the roller into equal halves. Further, each point of action of the resistive forces F6 and F7 is located at a widthwise center line of the sheet P (see arrows F6 and F7 positioned on the widthwise center lines). Resultant force of the feeding forces F1 through F4 and resultant force of the resistive forces F5 through F7 are computed as follows:

As shown in FIG. 6(*a*), since a resistive force F6 and F7 are aligned on the widthwise center line of the sheet P, these two are added together to represent a resultant force of (F6+F7) whose point of action is also positioned on the widthwise center line. On the other hand, a resultant force Fk of the resistive force F5 and (F6+F7) can be represented by a scalar of |F5|+|F6+F7| whose point of action extends from an internally dividing point on a line connecting between a point of action of F5 and a point of action of (F6+F7). The internally dividing point is on a point provided by dividing the line into a ratio of |F6+F7| to |F5|. In this manner, computed is the resultant resistive force Fk which is the combination of the resistive forces F5, F6 and F7.

In the similar way, a resultant force Fh of the sheet feeding forces F1 through F4 can be computed. More specifically, a resultant force F9 of the sheet feed forces F1 and F2 is computed. The resultant force F9 has a point of action positioned at an intermediate point between the point of action of the force F1 and the point of action of the force F2. Then, a resultant force F10 of the force F9 and F8 is computed. Therefore, the resultant force Fh can be computed by combining the force F10 and F4.

In the illustrated embodiment, each pressure force provided by the resist rollers 61 through 64 is determined so that the resultant forces Fk and Fh can be aligned on the identical line extending in a direction parallel to the sheet feeding direction. Accordingly, no rotational force is imparted on the sheet P on a sheet feed passage from the sheet supply roller unit 4 to the transfer roller 8. Consequently, diagonal sheet feeding is efficiently avoidable.

Further, the illustrated embodiment can also provide the function and effect similar to the above when loading the stack of minimum size sheets P1 in the sheet cassette 3. That is, as shown in FIGS. 3 and 6(*b*), the above described resistive force F5 is imparted on the minimum size sheet P1 from the free rotation roller 43. The point of action of the resistive force F5 is on the widthwise center line of the minimum size sheet P1. Further, a point of action of a resistive force F6' from the succeeding minimum sheet and a point of action of a resistive force F7' from the transfer roller 8 are also positioned on the widthwise center line of the minimum size sheet P1. Therefore, resultant resistive force is the sum of the forces F5, F6' and F7'.

On the other hand, sheet feed forces F1 and F2 are imparted on the sheet P1 from the resist rollers 61 and 62. (It should be noted that other resist rollers 63 and 64 are not in contact with the minimum size sheet P1). Resultant force Fh' of the sheet feed forces is positioned at a center between a point of action of the force F1 and a point of action of the force F2 with the magnitude of |F1|+|F2|. In the illustrated embodiment, the free rotation roller 43 is positioned at a widthwise center of the minimum size sheet P1, and the two resist rollers 61 and 62 are positioned symmetrically with respect to the widthwise center of the minimum size sheet P1. Therefore, resultant force Fh' and resultant force (F5+F6'+F7') are on an identical line extending in parallel with the sheet feed direction. As a result, diagonal feeding of the minimum size sheet P1 can be obviated.

A sheet feeding device according to a second embodiment of the present invention will be described. The second embodiment pertains to an improvement on the first embodiment. In the first embodiment, the liner force alignment is provided in the sheet P or P1 in the direction parallel to the sheet feeding direction by providing the sheet feeding force F3 and F4 smaller than F1 and F2. This is achieved by changing pressures from the pinch rollers 65 relative to respective resist rollers by the selection of each biasing force of the respective leaf springs 71.

Figure 5:
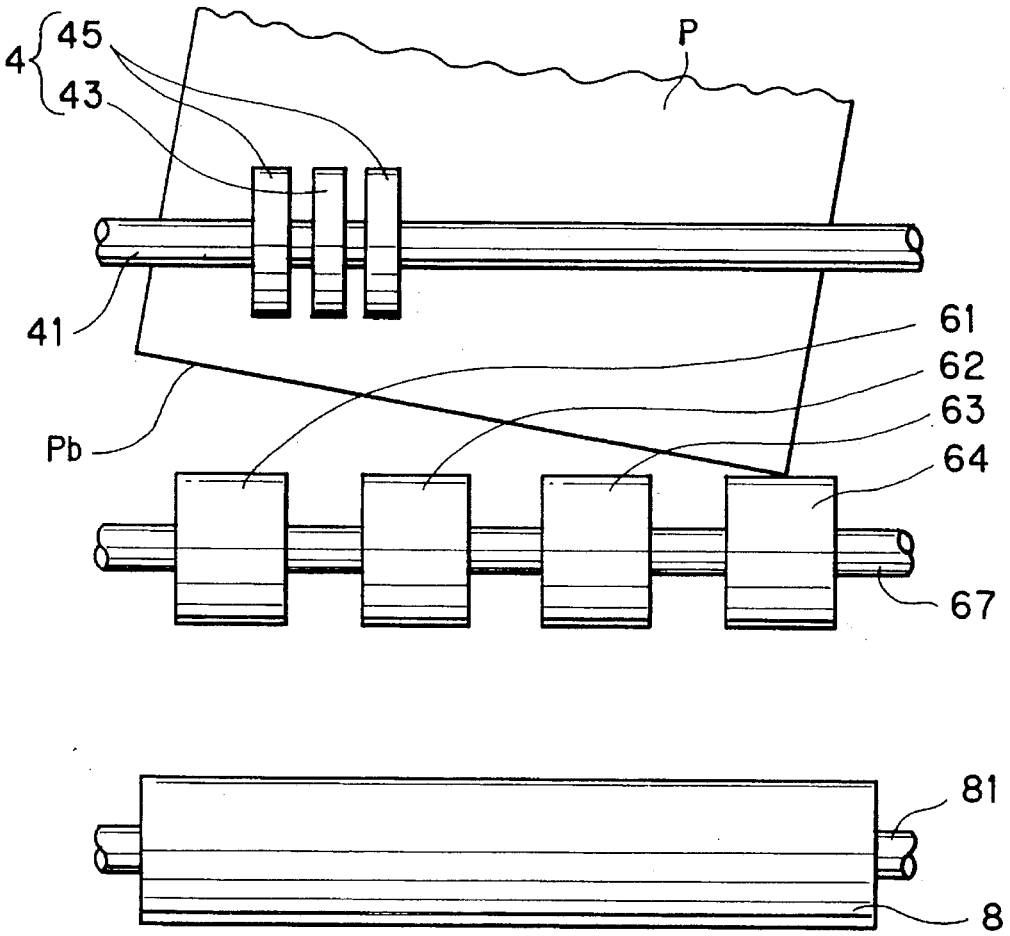
FIG. 5 is a schematic plan view showing accidental entry of a leading edge portion of the sheet into a space between a resist roller and a pinch roller during sheet slacking phase.

As described above, the rotation of the resist rollers 61 thru 64 is stopped or these are reversely rotated so as to provide a sheet slack at the leading edge portion until the all leading edge line of the sheet is brought into abutment with the resist rollers, whereby diagonal orientation of the sheet is provisionally corrected at the entry of the resist rollers. However, in the first embodiment, the nipping pressure of the resist rollers 63 and 64, is set smaller than that of the resist rollers 61 and 62. If the nipping pressure of the resist rollers 63 and 64, particularly the nipping pressure of the resist roller 64 is extremely small, the leading edge Pb of the corner portion of the sheet P may be entered into a minute space between the resist roller 63 and the corresponding pinch roller 65 and between the resist roller 64 and the corresponding pinch roller 65, if the sheet P is diagonally fed from the sheet supply roller unit 4 as shown in FIG. 5. Then, even if a sufficient sheet slack is provided by the continuous rotation of the integral rotation rollers 45, such diagonal introduction of the sheet P into the resist rollers cannot be sufficiently corrected.

The second embodiment can avoid this drawback by providing relatively high nipping pressure to the resist rollers 63 and 64 and providing the resist rollers 63 and 64 whose friction coefficient is lower than that of the resist rollers 61 and 62.

That is, the resist rollers 63 and 64 are made of a material whose friction coefficient is lower than that of the material of the resist rollers 61 and 62. With this arrangement the sheet feed force F3 and F4 becomes smaller than F1 and F2. For example, the resist rollers 63 and 64 can be formed of a synthetic resin such as polyacetal, whereas the resist rollers 61 and 62 are formed of rubber. In this case, the nipping pressure of the resist rollers 61 and 62 is set to 700*g* similar to he first embodiment, and nipping pressure of the resist roller 63 is set to 350*g* and nipping pressure of the resist roller 64 can be increased up to about 350*g*. Accordingly, the sheet feed force F1 and F2 can become greater than the sheet feed force F3 and F4, so that the liner force alignment is provided in the sheet P in the direction parallel to the sheet feeding direction. Further, because relatively high nipping pressure at the resist rollers 63 and 64 is provided, accidental entry of the leading edge portion of the sheet into the space under the resist rollers 63 and 64 can be avoided in case the sheet is diagonally fed toward the resist rollers from the sheet supply roller unit 4. Consequently, the leading edge Pb can surly be oriented in parallel with the rotation axis of the rotation shaft 67.

In the second embodiment, the friction coefficient of the resist rollers cannot be changed after assembly. However, nipping pressure with respect to each resist rollers can be changed after assembly by controlling displacement of the leaf springs 71. Therefore, optimum nipping pressure can be selected in association with the difference in friction coefficient with respect to each resist roller so as to provide a stabilized orientation of the sheet at the entry of the resist rollers.

Further, various modification may be conceivable in the second embodiment. For example, if the sheet feeding forces F1 and F2 and resistive force F5 are sufficiently large, the nipping pressure of the resist rollers 63 and 64 can be made equal to that of the resist rollers 61 and 62 by significantly lowering the friction coefficient of the resist rollers 63 and 64. Furthermore, the resist rollers can be formed of a rubber material if the resist rollers is provided slidably to some extend relative to the rotation shaft 67. In each case, diagonal feeding of the sheet P or P1 can be prevented.

Figure 7A:
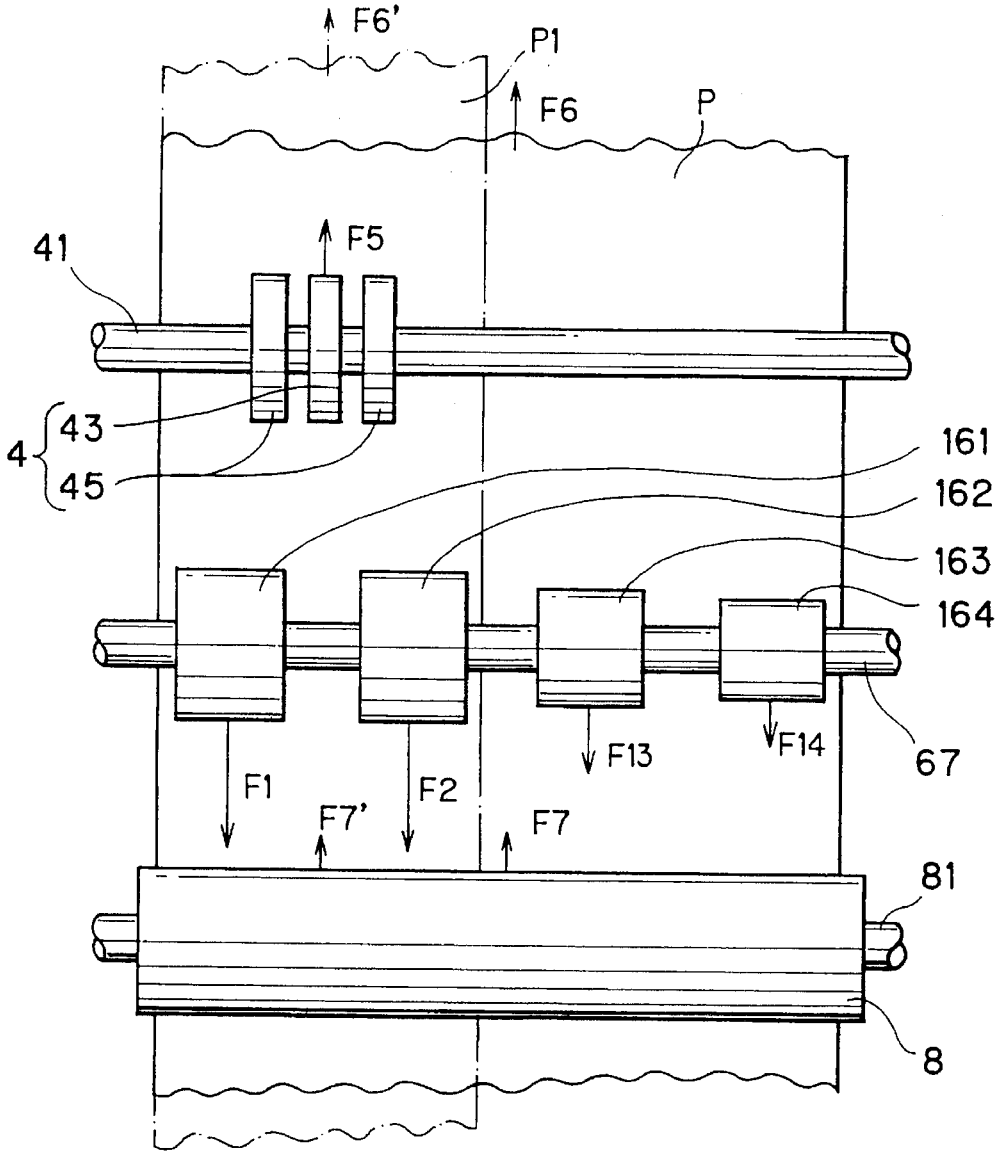
FIG. 7(*a*) is a schematic plan view showing a sheet feed arrangement from a sheet supply roller unit to an image transfer roller according to a third embodiment of the present invention.
Figure 7B:
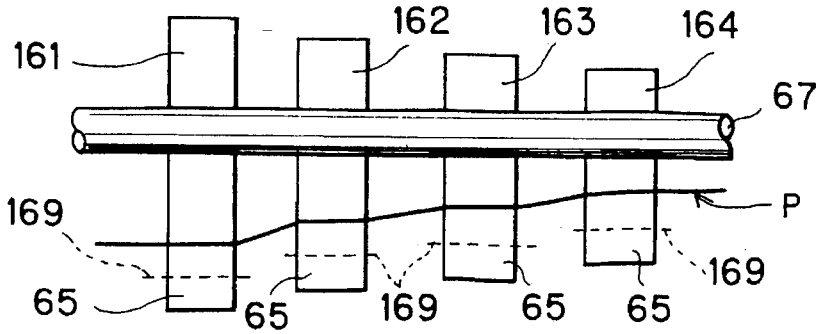

A sheet feeding device according to a third embodiment of the present invention will next be described with reference to FIGS. 7(*a*) and 7(*b*). In the third embodiment, sheet feed forces provided by each resist rollers 161 162, 163, 164 are different from one another by changing outer diameters of these rollers so as to provide peripheral speed different from one another. That is, an outer diameter of the resist roller 163 is smaller than that of the resist roller 162, and an outer diameter of the resist roller 164 is smaller than that of the resist roller 163. Further, these rollers 161, 162, 163, 164 are formed of rubber. On the other hand, as shown in FIG. 7(*b*) rotation shafts 169 of the corresponding pinch roller 65 are not aligned with each other but are offset from each other so as to provide nipping relation to the corresponding resist rollers. In this case, a minute stepped portions are created in the sheet P. However, it should be noted that FIGS. 7(*a*) and 7(*b*) are shown exaggeratedly to show difference in outer diameters of the resist rollers.

In the third embodiment, similar to the second embodiment, nipping pressure at the resist roller 164 is set greater than that of the first embodiment so as to avoid accidental entry of the leading edge portion of the sheet P into a space between the resist roller 164 and the pinch roller 65 during orientation of the leading edge or sheet slacking operation (non-rotation or reverse rotation period of the resist rollers).

According to the third embodiment, peripheral speed of the resist roller 162 is higher than that of the resist roller 163 and peripheral speed of the resist roller 163 is higher than that of the resist roller 164. In other words, sheet feeding speed by the resist roller 163 is lower than that by the resist roller 162, and sheet feeding speed by the resist roller 164 is lower than that by the resist roller 163. Thus, frictional resistance is generated between the resist roller 163 and the surface of the sheet P and between the resist roller 164 and the surface of the sheet P, the frictional resistance being the resistive force against the sheet feeding. Consequently, sheet feeding force F13 of the resist roller 163 becomes smaller than the sheet feeding force F2, and sheet feeding force F14 of the resist roller 164 becomes smaller than that of the resist roller 163.

As a result, similar to the foregoing embodiment, resultant force of the sheet feeding force F1, F2, F13, F14 and a resultant force of the resistive force F5, F6 and F7 are aligned in line in a direction parallel with the sheet feeding direction, thereby avoiding diagonal feeding of the sheet P.

Figure 8:
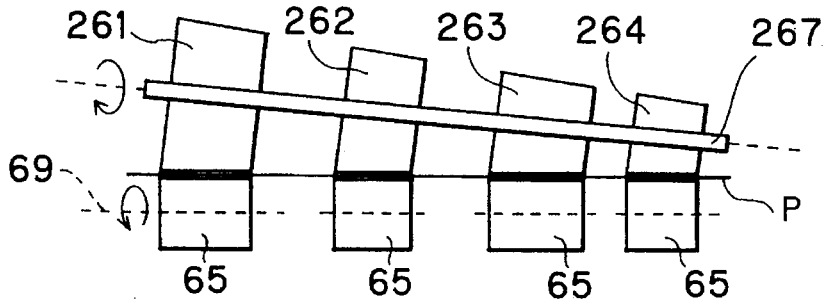
FIG. 8 is a cross-sectional view showing resist rollers and pinch rollers according to a modification to the third embodiment.

FIG. 8 shows a modification to the third embodiment. In this modification, each resist rollers 261, 262, 263 and 264 has a trapezoidal cross section in symmetry with respect to a rotation shaft 267, such that the size of the roller 261 is the greatest, and the size is successively smaller toward the resist roller 264. Further, the rotation shaft 267 of these resist rollers 261 through 264 is inclined with respect to the sheet P, in such a manner that one-end of the rotation shaft 267 positioned close to the supply roller 4 is spaced greatly apart from the sheet P, and another end of the rotation shaft 267 positioned far away from the supply roller 4 is spaced close to the sheet P. On the other hand, each rotation shafts 69 of the pinch rollers 65 are aligned with each other similar to the first and second embodiments.

According to the modification, sheet P can be maintained flat without formation of stepped portion when passing through the resist rollers, yet providing peripheral rotation speed of the resist rollers different from one another.

The above described sheet feeding device can be applied to various type of image recording apparatus such as an ink Jet printer instead of the laser printer 1. However, in case of the ink Jet printer, no image transfer roller is provided, and therefore, the above described resistive force F7 is not generated. Accordingly, liner force alignment between the resultant sheet feed force and resultant resistive force should be considered without the resistive force F7.

While the invention has been described in detail and with reference to specific embodiments thereof, it would be apparent to those skilled in the art that various changes and modifications may be made therein without departing from the spirit and scope of the invention.

For example, in the illustrated embodiments, the leaf springs 71 are used for urging the pinch rollers 65 toward the corresponding resist rollers. However, other type of biasing members such as coil springs and rubbers are available.

Further, in the third embodiment, diameters of the resist rollers 163, 164 can be changed by suitable replacement thereof in order to obtain optimum sheet feeding force F13 and F14. Even with the change, intended sheet nipping can be performed by controlling urging force of the pinch rollers 65 toward the resist rollers. Accordingly, fine control in linear orientation between the resultant sheet feeding force and resultant resistive force is achievable.

What is claimed is:

1. A sheet feeding device for feeding a sheet to a desired position in an image forming apparatus, the image forming apparatus having a sheet cassette for accommodating therein a stack of sheets and a sheet supply roller unit for supplying an uppermost sheet of the sheet stack to a position out of the sheet cassette, the sheet feeding device having a plurality of feed rollers arrayed side by side in a widthwise direction of the sheet and positioned downstream of the sheet supply roller unit with respect to a sheet feeding direction, the sheet supply roller unit being positioned deviatedly with respect to an array of the plurality of feed rollers, and partly providing a resistive force against sheet feeding, and the improvement comprising;

at least one of the plurality of feed rollers providing sheet feeding force different from the remaining plurality of feed rollers for providing a linear alignment between a resultant sheet feeding force provided by the plurality of feed rollers and a resultant resistive force against sheet feeding in a direction parallel with the sheet feeding direction.

2. The sheet feeding device as claimed in claim 1, further comprising a plurality of pinch rollers each positioned in nipping relation with each one of the plurality of feed rollers, each pinch rollers being urged toward the corresponding one of the plurality of rollers for providing sheet nipping force in association with the corresponding one of the plurality of rollers.

3. The sheet feeding device as claimed in claim 2, wherein at least one nipping pressure between at least one of the plurality of feed rollers and corresponding one of the pinch rollers is different from other nipping pressure between remaining one of the plurality of feed rollers and remaining one of the corresponding pinch rollers.

4. The sheet feeding device as claimed in claim 3, wherein the plurality of feed rollers comprises:

a rotation shaft extending in the widthwise direction of the sheet and parallel with the sheet;

a first roller mounted on the rotation shaft and positioned nearest to the sheet supply roller unit;

a second roller mounted on the rotation shaft and positioned beside the first roller;

a third roller mounted on the rotation shaft and positioned beside the second roller; and a fourth roller mounted on the rotation shaft and positioned beside the third roller and the farthest from the sheet supply roller unit; a nipping pressure at the third roller being smaller than that at the second roller, and a nipping pressure at the fourth roller being smaller than that at the third roller.

5. The sheet feeding device as claimed in claim 4, further comprising:

a plurality of rotation shafts for rotatably supporting each of the pinch rollers, the plurality of rotation shafts extending in alignment with each other; and a plurality of biasing members each biasing each of the plurality of rotation shafts toward the feed rollers.

6. The sheet feeding device as claimed in claim 5, wherein the sheet cassette is selectively accommodatable with a large width sheet and a small width sheet in such a manner that one side edge of the small width sheet being coincident with one side edge of the large width sheet when accommodating into the cassette, and wherein the sheet supply roller unit is positioned at a widthwise center portion of the small width sheet.

7. The sheet feeding device as claimed in claim 2, wherein at least one of the plurality of feed rollers has a friction coefficient with respect to the sheet lower than that of the remaining one of the plurality of feed rollers.

8. The sheet feeding device as claimed in claim 7, wherein the plurality of feed rollers comprises:

a rotation shaft extending in the widthwise direction of the sheet and parallel with the sheet;

a first roller mounted on the rotation shaft and positioned nearest to the sheet supply roller unit;

a second roller mounted on the rotation shaft and positioned beside the first roller;

a third roller mounted on the rotation shaft and positioned beside the second roller; and a fourth roller mounted on the rotation shaft and positioned beside the third roller and the farthest from the sheet supply roller unit; a friction coefficient of the third roller being lower than that of the second roller, and a friction coefficient of the fourth roller being lower than that of the third roller.

9. The sheet feeding device as claimed in claim 8, wherein the first and second rollers are formed of a rubber and the third and fourth rollers are formed of a synthetic resin.

10. The sheet feeding device as claimed in claim 9, further comprising:

a plurality of rotation shafts for rotatably supporting each of the pinch rollers, the plurality of rotation shafts extending in alignment with each other; and a plurality of biasing members each biasing each of the plurality of rotation shafts toward the feed rollers.

11. The sheet feeding device as claimed in claim 10, wherein the sheet cassette is selectively accommodatable with a large width sheet and a small width sheet in such a manner that one side edge of the small width sheet being coincident with one side edge of the large width sheet when accommodating into the cassette, and wherein the sheet supply roller unit is positioned at a widthwise center portion of the small width sheet.

12. The sheet feeding device as claimed in claim 11, further comprising means for stopping rotation of the rotation shaft of the first to fourth rollers for providing a sheet slack with respect to a leading edge area of the sheet fed by the sheet supply roller unit, the sheet slack being positioned immediately upstream of the first through fourth rollers for orienting a leading edge of the sheet in parallel with the rotation shaft.

13. The sheet feeding device as claimed in claim 2, wherein at least one of the plurality of feed rollers is rotatable at a peripheral speed different from that of the remaining one of the plurality of feed rollers.

14. The sheet feeding device as claimed in claim 13, wherein the plurality of feed rollers comprises:

a rotation shaft extending in the widthwise direction of the sheet and parallel with the sheet;

a first roller mounted on the rotation shaft and positioned nearest to the sheet supply roller unit;

a second roller mounted on the rotation shaft and positioned beside the first roller;

a third roller mounted on the rotation shaft and positioned beside the second roller; and a fourth roller mounted on the rotation shaft and positioned beside the third roller and the farthest from the sheet supply roller unit; an outer diameter of the third roller being smaller than that of the second roller, and an outer diameter of the fourth roller being smaller than that of the third roller.

15. The sheet feeding device as claimed in claim 14, further comprising:

a plurality of rotation shafts for rotatably supporting each of the pinch rollers, the plurality of rotation shafts extending in offset relation from each other; and a plurality of biasing members each biasing each of the plurality of rotation shafts toward the feed rollers.

16. The sheet feeding device as claimed in claim 15, wherein the sheet cassette is selectively accommodatable with a large width sheet and a small width sheet in such a manner that one side edge of the small width sheet being coincident with one side edge of the large width sheet when accommodating into the cassette, and wherein the sheet supply roller unit is positioned at a widthwise center portion of the small width sheet.

17. The sheet feeding device as claimed in claim 13, wherein the plurality of feed rollers comprises:

a rotation shaft extending in the widthwise direction of the sheet and inclined with respect to the sheet;

a first roller mounted on the rotation shaft and positioned nearest to the sheet supply roller unit;

a second roller mounted on the rotation shaft and positioned beside the first roller;

a third roller mounted on the rotation shaft and positioned beside the second roller; and a fourth roller mounted on the rotation shaft and positioned beside the third roller and the farthest from the sheet supply roller unit;

the first through fourth rollers having a trapezoidal shape in cross-section and symmetrical with respect to the rotation shaft; a diameter of the first to fourth rollers being gradually reduced toward the fourth roller.

18. The sheet feeding device as claimed in claim 17, further comprising:

a plurality of rotation shafts for rotatably supporting each of the pinch rollers, the plurality of rotation shafts extending in alignment with each other; and a plurality of biasing members each biasing each of the plurality of rotation shafts toward the feed rollers.

19. The sheet feeding device as claimed in claim 18, wherein the sheet cassette is selectively accommodatable with a large width sheet and a small width sheet in such a manner that one side edge of the small width sheet being coincident with one side edge of the large width sheet when accommodating into the cassette, and wherein the sheet supply roller unit is positioned at a widthwise center portion of the small width sheet.

20. The sheet feeding device as claimed in claim 1, wherein the sheet supplying roller unit comprises a semicircular roller having an arcuate surface, a length of the arcuate surface being greater than a distance between sheet supplying roller unit and the plurality of feed rollers for providing a sheet slack at a leading edge portion of the sheet.

* * * * *